US006471349B1

(12) United States Patent
Aurenty et al.

(10) Patent No.: US 6,471,349 B1
(45) Date of Patent: Oct. 29, 2002

(54) METHOD TO PREPARE A PRINTING PLATE AND PRINTING PLATE

(75) Inventors: Patrice M. Aurenty, Wood-Ridge, NJ (US); Alexander Grant, Bloomfield, NJ (US); Edward Stone, Morris Plains, NJ (US); William P. Keaveney, Pompton Plains, NJ (US)

(73) Assignee: Kodak Polychrome Graphics LLC, Norwalk, CT (US)

( * ) Notice: Subject to any disclaimer, the term of this patent is extended or adjusted under 35 U.S.C. 154(b) by 0 days.

(21) Appl. No.: 09/492,646

(22) Filed: Jan. 27, 2000

(51) Int. Cl.[7] ..... B41J 2/01
(52) U.S. Cl. ..... 347/100; 347/105
(58) Field of Search ..... 347/100, 105; 101/463.1; 428/195

(56) References Cited

U.S. PATENT DOCUMENTS

| | | | | |
|---|---|---|---|---|
| 3,877,372 A | | 4/1975 | Leeds | 101/465 |
| 4,278,467 A | | 7/1981 | Fadner | 196/2 |
| 4,833,486 A | | 5/1989 | Zerillo | 346/1.1 |
| 4,854,969 A | | 8/1989 | Bassemir | 106/2 |
| 5,368,974 A | | 11/1994 | Walls et al. | 430/160 |
| 5,861,230 A | | 1/1999 | Lambert et al. | 430/202 |
| 5,942,335 A | * | 8/1999 | Chen et al. | 347/105 |

FOREIGN PATENT DOCUMENTS

| | | | | |
|---|---|---|---|---|
| EP | 503621 | | 9/1992 | |
| EP | 591916 | | 4/1994 | |
| EP | 0802067 | | 8/1996 | |
| EP | 0802067 | A1 * | 10/1997 | B41N/1/14 |
| EP | 0897795 | A1 * | 2/1999 | B41C/1/10 |
| EP | 0897795 | | 2/1999 | |
| EP | 0949539 | | 10/1999 | |
| EP | 0949539 | A2 * | 10/1999 | B41C/1/10 |
| EP | 0965887 | | 12/1999 | |
| EP | 0965887 | A1 * | 12/1999 | B41C/1/10 |
| WO | 0046038 | | 8/2000 | |

* cited by examiner

*Primary Examiner*—John Barlow
*Assistant Examiner*—Manish S. Shah
(74) *Attorney, Agent, or Firm*—Baker Botts LLP

(57) ABSTRACT

A printing plate is prepared by the process including: (a) providing a substrate; and (b) applying by ink jetting to the substrate a fluid composition comprising a compound which comprises at least one nitrogen-containing heterocyclic moiety, providing a printing plate that is ready-to-use on a press without having to develop it. The printing plate of this invention is capable of extended press run length and advantageously avoids the need of chemical development.

37 Claims, No Drawings

METHOD TO PREPARE A PRINTING PLATE AND PRINTING PLATE

FIELD OF THE INVENTION

This invention relates to a printing plate printing, a method of making such a printing plate, and a method of printing using such a plate to form a desired image on a medium. More particularly, the printing plate of this invention employs a printing plate substrate and a fluid composition comprising a compound that comprises a nitrogen-containing heterocyclic moiety that exhibits strong adhesion to a substrate. The fluid composition is applied by ink jetting to the substrate, providing a printing plate that is ready-to-use on a press without having to develop it.

BACKGROUND OF THE INVENTION

The offset lithographic printing process has long used a developed planographic printing plate having oleophilic image areas and hydrophilic non-image areas. The plate is commonly dampened before or during inking with an oil-based ink composition. The dampening process utilizes an aqueous fountain solution such as those described in U.S. Pat. Nos. 3,877,372, 4,278,467 and 4,854,969. When water is applied to the plate, the water will form a film on the hydrophilic areas, which are the non-image areas of the plate, but will contract into tiny droplets on the oleophilic plate areas, which are the image areas. When a roller carrying an oil-based ink composition is passed over the dampened plate, it will not ink the non-image areas that are covered by the aqueous film, but will emulsify the water droplets on the water repellant image areas, which will then take up ink. The resulting ink image is transferred, or "offset," onto a rubber blanket, which is then used to print onto a medium such as paper.

It has been proposed to apply "direct" ink jet printing techniques to lithographic printing. For example, European Patent Publication No. 503,621 discloses a direct method to make lithographic plates by jetting a photocurable ink onto the plate substrate, and then exposing the plate to ultraviolet radiation to harden the image area. An oil-based ink may then be transferred to the image area for printing onto a printing medium. But, neither the resolution of ink drops jetted onto the substrate, nor the durability of the lithographic printing plate with respect to printing runlength was disclosed.

It has also been proposed to apply the direct ink jet printing techniques without the additional steps of chemical development of the plate. This approach advantageously results in lower production costs and a more environmentally acceptable printing process. However, in such techniques it is difficult to control the spreading of the ink jetted fluid that forms the oleophilic ink-accepting regions on the printing plate substrate. Such "dot spreading" causes lower printing image resolution and reduced image quality. For example, European Patent Application No. 591,916 A2 discloses a water-based ink having a polymer containing anhydride groups which are thermally cross-linked with a hydroxy-functional polymer. This formulation is applied by jetting the formulation which is at room temperature onto a room temperature substrate. However, this formulation does not achieve good control of dot spreading.

U.S. Pat. No. 4,833,486 discloses the apparatus and process for imaging a plate with a "hot melt" type of ink jet printer. The image is produced by jetting at high temperature a "phase change" type of ink which solidifies when it hits the cooler substrate. The ink becomes instantaneously solid rather than remaining a liquid or gel which is thereafter cured to form a solid. However, such an ink does not provide good resistance to press run due to the wax-type nature of the ink formulation.

U.S. Pat. No. 5,942,335 discloses the use of a polymer containing a nitrogen-containing heterocyclic group, namely a polymer of 4-vinylpyridine, in the formulation of an ink receiving layer of an ink jet recording sheet. However, the use of such a compound in a fluid composition applied directly to a printing plate substrate to form an imaged, ink-receptive layer is not disclosed.

Thus, it would be advantageous to employ a printing plate capable of extended press run length which does not require chemical development.

It is one object of this invention to provide such a printing plate. It is another object of this invention to provide a method of preparing such a printing plate. It is yet another object of this invention to provide a method of using such a printing plate. The printing plate of this invention may advantageously be prepared without a chemical development step typically required. The printing plate of this invention is also capable of extended press run length.

SUMMARY OF THE INVENTION

The fluid composition of this invention is suitable for ink jetting upon a substrate and comprises a compound which comprises at least one nitrogen-containing heterocyclic moiety, the compound being dissolved in a diglyme or glycolic solution and ink jetted.

The printing plate of this invention is prepared by: (a) providing a substrate; and (b) applying by ink jetting to the substrate a fluid composition as described. Optionally, a surfactant is applied to at least one surface of the substrate to prepare a "printing plate precursor" upon which the fluid composition is imagewise ink jetted. In preferred embodiments, the compound that comprises at least one nitrogen-containing heterocyclic moiety is selected from the group consisting of polymers or copolymers of 2-vinylpyridines, polymers or copolymers of 4-vinylpyridines, polymers or copolymers of ethylimidazolidone methacrylates, 2-pyridyl ethyl trimethoxysilanes, and mixtures thereof. In a particularly preferred embodiment, the nitrogen-containing heterocyclic moieties of the compound are free basic amines in non-aqueous solution.

The printing plate of this invention is capable of extended press run length and advantageously avoids the need of chemical development.

DETAILED DESCRIPTION OF THE INVENTION

To achieve extended printing runs with printing plates the oleophilic material must adhere well to the substrate. Adhesion of the oleophilic material may be controlled in at least two ways. First, the oleophilic material should have a chemical interaction with the substrate that provides a type of chemical binding and promotes adhesion. For example, the chemical composition of the oleophilic material can be varied to promote its adhesion to the substrate. Also, the composition of the substrate can be varied to increase binding of the oleophilic material. Second, the substrate should provide microscopic topology that allows the oleophilic material to interlock mechanically with the substrate when dry or hardened. Mechanical interlocking can be affected by roughening the surface of the substrate. Thus, by controlling these variables, a printing plate can be made with increased adhesion of the oleophilic material, and correspondingly longer printing run operation.

In the invention described here, the oleophilic material is placed on the substrate by ink jetting a fluid composition comprising the oleophilic layer-forming compound. Here, the fluid composition provides excellent adhesion of the oleophilic layer for longer press runs of the printing plate because the oleophilic layer-forming compound used in the fluid composition exhibits remarkable adhesion to the substrates employed.

Without intending to be bound by any one particular theory, the oleophilic layer-forming compound used in the fluid composition comprises at least one nitrogen-containing heterocyclic moiety in free basic amine form which can chemically interact with the substrate in several ways to provide adhesion. First, the nitrogen-containing heterocyclic moieties can react with Bronsted acidic sites on the substrate in acid-base neutralization. Second, the nitrogen-containing heterocyclic moieties can react with Lewis acidic sites on the substrate surface and form chemical bonds as a Lewis base electron donor. These two types of interactions occur only if the nitrogen-containing heterocyclic moieties are not previously reacted with acid, but remain substantially in the free base form in non-aqueous solvent in the fluid composition. Third, the nitrogen-containing heterocyclic moieties have enhanced VanderWaals interactions with the substrate surface atoms due to their cyclic or aromatic ring structures.

The chemical binding of the oleophilic layer-forming compound to the substrate works in combination with the physico-chemical adsorption of the compound to the roughened substrate to provide strong adhesion of the ink-receiving layer, a more durable printing plate, and longer printing press runs.

The printing plate of this invention encompasses lithographic printing plates, flexographic printing plates, and gravure printing plates.

Conventional printing plate substrates such as aluminum, polymeric film, and paper may be used as the printing plate substrate of this invention. The printing plate substrate may be subjected to treatments such as electrograining, anodization, and silication to enhance its surface characteristics. The surface characteristics that are modified by such treatments are roughness, topology, and the nature and quantity of surface chemical sites.

Substrates that can be employed are given in Table 1. Substrates chosen for use in this invention are preferably based on aluminum oxide, and may be subjected to various conventional surface treatments as are well known to those skilled in the art to give a surface that has acidic or basic character in the Bronsted acid-base view. These treatments also result in different surface roughness, topology, and surface chemical sites, as summarized in Table 1.

TABLE 1

Substrates for printing plates

| Substrate name | Surface Treatment | Interlayer Treatment | Surface Property |
|---|---|---|---|
| AA | Quartz Grained and Anodized | None | Acidic |
| EG-PVPA | Electrograined and Anodized | Polyvinyl phosphoric acid | Acidic |

TABLE 1-continued

Substrates for printing plates

| Substrate name | Surface Treatment | Interlayer Treatment | Surface Property |
|---|---|---|---|
| PF | Electrograined and Anodized | Sodium dihydrogen phosphate/Sodium fluoride | Acidic |
| G20 | Electrograined and Anodized | Vinylphosphonic acid/acrylamide copolymer | Acidic/ Amphoteric |
| EG-Sil | Electrograined and Anodized | Sodium Silicate | Basic |
| DS-Sil | Chemically Grained and Anodized | Sodium Silicate | Basic |
| PG-Sil | Pumice Grained and Anodized | Sodium Silicate | Basic |
| CHB-Sil | Chemically Grained, Anodized and Silicated | Sodium Silicate | Basic |

"AA" means "as anodized." The aluminum surface is first quartz grained and then anodized using DC current of about 8 A/cm$^2$ for 30 seconds in a $H_2SO_4$ solution (280 g/liter) at 30° C.

"EG" means "electrolytic graining." The aluminum surface is first degreased, etched and subjected to a desmut step (removal of reaction products of aluminum and the etchant). The plate is then electrolytically grained using an AC current of 30–60 A/cm$^2$ in a hydrochloric acid solution (10 g/liter) for 30 seconds at 25° C., followed by a post-etching alkaline wash and a desmut step. The grained plate is then anodized using DC current of about 8 A/cm$^2$ for 30 seconds in a $H_2SO_4$ solution (280 g/liter) at 30° C.

"PVPA" is a polyvinylphosphonic acid. The plate is immersed in a PVPA solution and then washed with deionized water and dried at room temperature.

"DS" means "double sided smooth." The aluminum oxide plate is first degreased, etched or chemically grained, and subjected to a desmut step. The smooth plate is then anodized.

"Sil" means the anodized plate is immersed in a sodium silicate solution to coat it with an interlayer. The coated plate is then rinsed with deionized water and dried at room temperature.

"PG" means "pumice grained." The aluminum surface is first degreased, etched and subjected to a desmut step. The plate is then mechanically grained by subjecting it to a 30% pumice slurry at 30° C., followed by a post-etching step and a desmut step. The grained plate is then anodized using DC current of about 8 A/cm$^2$ for seconds in an $H_2SO_4$ solution (280 g/liter) at 30° C. The anodized plate is then coated with an interlayer.

"G20" is a printing plate substrate which is described in U.S. Pat. No. 5,368,974, the disclosure of which is incorporated herein by reference in its entirety.

"CHB" means chemical graining in a basic solution. After an aluminum substrate is subjected to a matte finishing process, a solution of 50 to 100 g/liter NaOH is used during graining at 50 to 70° C. for 1 minute. The grained plate is then anodized using DC current of about 8 A/cm$^2$ for 30 seconds in an $H_2SO_4$ solution (280 g/liter) at 30° C. The anodized plate is then coated with a silicated interlayer.

"PF" substrate has a phosphate fluoride interlayer. The process solution contains sodium dihydrogen phosphate and sodium fluoride. The anodized substrate is treated in the solution at 70° C. for a dwell time of 60 seconds, followed by a water rinse, and drying. The deposited dihydrogen phosphate is about 500 mg/$M^2$.

A "basic" surface will have a plurality of basic sites and acidic sites present, with the basic sites predominating to some degree. Similarly, an "acidic" surface will have a plurality of acidic sites and basic sites present, with the acidic sites predominating to some degree. It is known by one of ordinary skill in the art that the PG-Sil printing plate substrate appears to have a higher silicate site density than the DS-Sil printing plate substrate, and is more basic. It is also known that the G20 printing plate substrate exhibits less acidic character than AA printing plate substrates.

The oleophilic layer-forming compound of this invention preferably comprises a nitrogen-containing heterocyclic moiety. It may be a monomeric compound, or it may be a polymeric compound. If it is a polymeric compound, it may be a homopolymer, copolymer, terpolymer, and the like. By "copolymer" we mean any polymer comprised of more than one type of monomer, prepared in a copolymerization. By "terpolymer" we mean a polymer consisting essentially of three types of monomers, prepared in a copolymerization. Thus, a copolymer can include a terpolymer.

Here, the oleophilic layer-forming compound is preferably selected from the group consisting of polymers or copolymers of 2-vinylpyridines, polymers or copolymers of 4-vinylpyridines, polymers or copolymers of ethylimidazolidone methacrylates, 2-pyridyl ethyl trimethoxysilanes, and mixtures thereof.

The ink-receptive layer produced with the oleophilic layer-forming compound has excellent adhesion to the substrate surface, and as set forth in further detail below, the resulting printing plate exhibits extended press run length. Advantageously, the superior results of the printing plate of this invention are achieved without chemical development.

The fluid composition comprising the oleophilic layer-forming compound is preferably applied by ink jetting to the substrate surface, typically by an ink jet printer using equipment and techniques which are well known to those skilled in the art. In this manner, the substrate plate is imaged so that after the fluid composition dries, an ink receptive layer is formed in the desired image on the surface of the substrate.

Adsorbing a surfactant to a conventional printing plate substrate, prior to application of an ink receptive layer, can improve the image resolution achieved. Such a surfactant-pretreated substrate will be termed a "printing plate precursor" herein. A printing plate may be prepared from the printing plate precursor by imagewise applying a fluid composition as described above to the substrate. In a preferred embodiment, the fluid composition is applied by means of an ink jet printer, and then dried to form an ink receptive layer in the form of the desired image. Advantageously, chemical development of the printing plate is not required.

Adhesion of the compound from the fluid composition to the substrate after drying is not diminished substantially by the presence of the precursor plate surfactant, which tends only to slow the spreading of the droplet deposited by the ink jet nozzle. Thus, the precursor plate surfactant can increase resolution without reducing press run length. Surfactants that can be used for the precursor include alkyl tail surfactants, fluorosurfactants and siliconated surfactants.

Illustrative examples of alkyl tail surfactants include sodium dodecylsulfate, isopropylamine salts of an alkylarylsulfonate, sodium dioctyl succinate, sodium methyl cocoyl taurate, dodecylbenzene sulfonate, alkyl ether phosphoric acid, N-dodecylamine, dicocoamine, 1-aminoethyl-2-alkylimidazoline, 1-hydroxyethyl-2-alkylimidazoline, and cocoalkyl trimethyl quaternary ammonium chloride, polyethylene tridecyl ether phosphate, and the like.

Illustrative examples of fluorosurfactants useful in preferred embodiments of the present invention and their commercial trade names are set forth in Table 2.

TABLE 2

Fluorosurfactants useful in preferred embodiments

| Trade Name | Chemical Structure | Type |
|---|---|---|
| Zonyl FSD | $F(CF_2CF_2)_{1-7}$-alkyl-$N^+R_3Cl^-$ | Cationic |
| Fluorad FC-135 | $C_8F_{17}SO_2NHC_3H_6N^+(CH_3)_3I^-$ | Cationic |
| Zonyl FSA | $F(CF_2CF_2)_{1-7}CH_2CH_2SCH_2CH_2CO_2$-$Li^+$ | Anionic |
| Fluorad FC-129 | $C_8F_{17}SO_2N(C_2H_5)CH_2CO_2$-$K^+$ | Anionic |
| Zonyl FSP | $(F(CF_2CF_2)_{1-7}CH_2CH_2O)_{1.2}PO(O^-NH_4^+)_{1.2}$ | Anionic |
| Zonyl FSJ(1) | $(F(CF_2CF_2)_{1-7}CH_2CH_2O)_{1.2}PO(O^-NH_4^+)_{1.2}$ | Anionic |
| Fluorad FC-120 | $C_{10}F_{21}SO_3^{-NH}{}_4^+$ | Anionic |
| Zonyl FS-62 | $C_6F_{13}CH_2CH_2SO_3H$, $C_6F_{13}CH_2CH_2SO_3^-NH_4^+$ | Anionic |
| Zonyl FSK | $F(CF_2CF_2)_{1-7}CH_2CHOAcCH_2N^+R_2CH_2COO^-$ | Amphoteric |
| Fluorad FC-100(2) | $R^{**}SO_3^-$ | Amphoteric |
| Fluorad FC-170C | $C_8F_{17}SO_2N(C_2H_5)(CH_2CH_2O)_x$ | Nonionic |
| Fluorad FC-171 | $C_8F_{17}SO_2N(C_2H_5)(CH_2CH_2O)_xCH_3$ | Nonionic |
| Zonyl FSO(3) | $F(CF_2CF_2)_{1-7}CH_2CH_2O(CH_2CH_2O)_yH$ | Nonionic |
| Zonyl FS-300(3) | $F(CF_2CF_2)_{1-7}CH_2CH_2O(CH_2CH_2O)_zH$ (z > y) | Nonionic |

(1)FSJ also contains a nonfluorinated surfactant.
(2)R** contains an ammonium function.
(3)y or z = 0 to about 25.

ZONYL surfactants are commercially available from E.I. du Pont de Nemours & Co. and have a distribution of perfluoroalkyl chain length. FLUORAD surfactants are commercially available from 3M Company and have a narrow distribution of the hydrophobic chain length.

Illustrative siliconated surfactants include the following non-exhaustive listing: polyether modified poly-dimethyl-siloxane, silicone glycol, polyether modified dimethyl-polysiloxane copolymer, and polyether-polyester modified hydroxy functional polydimethyl-siloxane.

The precursor plate surfactant may be adsorbed onto the substrate by any conventional method, preferably by immersion of the substrate in an aqueous solution of the surfactant for a time, typically one minute, which is effective to permit adsorption of the surfactant upon the substrate. In a particularly preferred embodiment, any non-adsorbed surfactant is then removed from the printing plate substrate surface. Preferably, the substrate is rinsed with water to remove non-adsorbed surfactant, then dried. The resulting printing plate precursor has a surfactant on at least one surface, in an amount effective to improve the resolution of printing.

An imaged substrate prepared by imagewise applying a fluid composition to a substrate could also be used, for example, as a precursor for a printed circuit board in which conductive metals are deposited onto the imaged substrate.

The following examples are given to illustrate preferred embodiments of the present invention and are not intended to limit the invention in any way. It should be understood that the present invention is not limited to the above-mentioned embodiments. Numerous modifications can be made by one skilled in the art having the benefits of the teachings given here. Such modifications should be taken as being encompassed within the scope of the present invention as set forth in the appended claims.

Example 1

A fluid composition was prepared by dissolving a 4-vinylpyridine copolymer, R2930-14, in diglyme (bis(2-methoxyethyl)ether) to 1 weight percent. This fluid composition was ink-jetted with an EPSON printer onto PF and G20 substrates (Table 1) that were pretreated with FLUORAD FC-129 precursor plate surfactant (0.01 weight percent in water). After drying without processing or developing, the images on these substrates did not rub off with a pad impregnated with ink and water. These printing plates were used in accelerated press trials of 15,000 impressions on paper, at which point no evidence of image wear was observed. Thus, the plates were suitable for low volume printing. The accelerated press trial used a rubber transfer blanket of high hardness that accelerates wear of the printing plate. This fluid composition was also suitable for very low volume printing (less than 4000 impressions) on EG-Sil substrate (Table 1) pretreated with FLUORAD FC-135 (0.1 weight percent in water) surfactant.

The 4-vinylpyridine copolymer, R2930-14, was prepared from methyl methacrylate (MMA), 4-vinylpyridine (4-VP), ethylacrylate (EA), and hydroxyethylacrylate (HEA) in the ratio 45.6:26.7:14.83:12.87. A 2L roundbottom flask was charged with 240 g methyl isobutyl ketone (MIBK), and the solvent was stirred 1.5 and heated to reflux under nitrogen. Separate addition funnels were charged with, (1) a blend of 114 g MMA, 66.75 g 4-VP, 37.08 g EA, and 32.18 g HEA, and (2) a solution of 2 g VAZO 88 (DuPont) in 25 g MIBK. Dual addition was carried out for 2.5 hours at reflux, and then the large funnel rinsed into the batch with 20 g MIBK. During the next 3.5 hours at reflux, two small initiator post-adds of 0.25 g VAZO 88 in 5 g MIBK and 0.16 g VAZO 88 in 5 g MIBK were made. The apparatus was converted from reflux to distillation, and about 136 g distillate removed before heating was halted. At below 85°, a blend of 21.9 g formic acid and 610 g water was added, and the heterogeneous mixture was heated again while diluting with 40 g water. Azeotropic distillation was carried out until very little upper layer was collecting, at about 99°–100°. Lower layer collected at less than 95° was returned to the reactor. the batch reached 100°. As the opaque, viscous batch cooled, it was diluted with 70 g n-propanol and 7 g additional formic acid. Typical recovery was 948 g, pH 4.2, total solids 25%, Brookfield viscosity 1968cp (25°, 20 rpm).

A printing plate that survives an accelerated press trial of fifteen thousand impressions with no evidence of wear of the ink-receiving layer on the substrate or in the printed impressions is suitable for a variety of commercial applications. Such a plate is called suitable for "low volume" printing since a press run of fifteen thousand is a low volume commercial run. It should be noted that passing an accelerated press trial of fifteen thousand impressions with no evidence of wear means that the plate is capable of a substantially longer press run than fifteen thousand under ordinary commercial printing conditions.

A printing plate that shows evidence of wear of the ink-receiving layer on the substrate or in the printed impressions for a run of about one thousand to less than about fifteen thousand impressions is a plate that is suitable for "very low volume" printing. A printing plate that shows evidence of wear of the ink-receiving layer on the substrate or in the printed impressions for a run of less than about one thousand impressions is a plate that is not suitable for commercial printing, although it has utility to form an image.

Example 2

A fluid composition was prepared by dissolving a 4-vinylpyridine copolymer (Scientific Polymer Products, Inc.) in diglyme to 1 weight percent. This fluid composition was ink-jetted with an EPSON printer onto a G20 substrate (Table 1) that was pretreated with FLUORAD FC-129 precursor plate surfactant (0.01 weight percent in water). After drying without processing or developing, the image on this substrate did not rub off with a pad impregnated with ink and water. This printing plate was used in an accelerated press trial of 15,000 impressions on paper, at which point no evidence of image wear was observed. Thus, this plate was suitable for low volume printing. This fluid composition was not suitable for commercial printing (less than 500 impressions) on EG-Sil substrate (Table 1) pretreated with FLUORAD FC-135 (0.1 weight percent in water) surfactant.

Example 3

A fluid composition was prepared by dissolving a ethylimidazolidone methacrylate copolymer, R2930-13, in diglyme to 1 weight percent. This fluid composition was ink jetted with an EPSON printer onto AA and PF substrates (Table 1) that were pretreated with FLUORAD FC-129 precursor plate surfactant (0.01 weight percent in water). After drying without processing or developing, the images on these substrates did not rub off with a pad impregnated with ink and water. These printing plates were used in accelerated press trials of 15,000 impressions on paper, at which point no evidence of image wear was observed. Thus, these plates were suitable for low volume printing. This fluid composition did not adhere to EG-Sil substrate (Table 1) pretreated with FLUORAD FC-135 (0.1 weight percent in water) surfactant.

The ethylimidazolidone methacrylate copolymer, R2930-13, was prepared from methyl methacrylate (MMA), 2-(dimethylamino)ethyl methacrylate (DMAEMA), and ethylimidazolidone methacrylate (MEIO), in the ratio 72:23:5. A 2L roundbottom flask was charged with 240 g methyl isobutyl ketone (MIBK), and the solvent was stirred and heated to reflux under nitrogen. Separate addition funnels were charged with, (1) a blend of 57.5 g DMAEMA, 62.5 g Norsocryl 100 (Elf-Atochem: 20% MEIO, 80% MMA), and 130 g MMA, and (2) a solution of 2 g VAZO 88 (DuPont) in 25 g MIBK. Dual addition was carried out for 2.5 hours at reflux, and then the large funnel rinsed into the batch with 20 g MIBK. An hour later, an initiator post-add of 0.25 g VAZO 88 in 5 g MIBK was made. Two hours after the post-add, the apparatus was converted from reflux to distillation, and about 90 g distillate removed before heating was halted. At below 85°, a blend of 15.2 g formic acid and 610 g water was added, and the opaque mixture heated again. Azeotropic distillation began, returning the lower layer to the reactor until the batch temperature reached 95°. This stage continued until the batch reached 100° and no more upper layer was collecting. As the batch cooled, another 30 g water was added with mixing. Typical recovery was 810 g, pH 6.0, total solids 27%, Brookfield viscosity 1450cp (25°, 20 rpm).

Example 4

A fluid composition was prepared by dissolving 2-pyridyl ethyl trimethoxysilane (Gelest, Inc.), in diglyme to 1 weight percent. This fluid composition was ink-jetted with an EPSON printer onto an EG-Sil substrate (Table 1) that was pretreated with FLUORAD FC-135 precursor plate surfactant (0.1 weight percent in water). After drying without processing or developing, the image on this substrate did not rub off with a pad impregnated with ink and water. This printing plate was used in an accelerated press trial of 15,000 impressions on paper, at which point no evidence of image wear was observed. Thus, this plate was suitable for low volume printing. The accelerated press trial used a rubber transfer blanket of high hardness that accelerates wear of the printing plate. This fluid composition did not adhere to AA or PF substrates.

Example 5

A fluid composition was prepared by dissolving a 2-vinylpyridine polymer (Scientific Polymer Products, Inc.) in diglyme to 1 weight percent. This fluid composition was ink-jetted with an EPSON printer onto an EG-Sil substrate (Table 1) that was pretreated with FLUORAD FC-135 precursor plate surfactant (0.1 weight percent in water). After drying without processing or developing, the image on this substrate did not rub off with a pad impregnated with ink and water. This printing plate was used in an accelerated press trial of 15,000 impressions on paper, at which point no evidence of image wear was observed. Thus, this plate was suitable for low volume printing. The accelerated press trial used a rubber transfer blanket of high hardness that accelerates wear of the printing plate. This fluid composition was not suitable for commercial printing (less than 100 impressions) on G20 substrate (Table 1) pretreated with FLUORAD FC-129 (0.01 weight percent in water) surfactant.

The invention claimed is:

1. A printing plate prepared by the process comprising:

(a) providing a printing plate substrate; and (b) imagewise applying by ink jetting to the substrate a fluid composition comprising a compound comprising a nitrogen-containing heterocyclic moiety in non-aqueous solvent.

2. The printing plate of claim 1, in which the printing plate is dried subsequent to application of the fluid composition.

3. The printing plate of claim 1, in which the non-aqueous solvent is diglyme.

4. The printing plate of claim 1, in which said compound is a polymer or copolymer comprising a monomer selected from the group consisting of 2-vinylpyridines, 4-vinylpyridines, and ethylimidazolidone methacrylates.

5. The printing plate of claim 1, in which said compound is a copolymer of 4-vinylpyridine and butyl methacrylate.

6. The printing plate of claim 1, in which said compound is a copolymer of 4-vinylpyridine, hydroxyethyl acrylate, ethyl acrylate, and methyl methacrylate.

7. The printing plate of claim 1, in which said compound is 2-pyridyl ethyl trimethoxysilane.

8. A printing plate comprising:

(a) a printing plate substrate; and (b) an imaged ink-receptive layer residing on the substrate, wherein the layer comprises a compound comprising a nitrogen-containing heterocyclic moiety in non-aqueous solvent imagewise applied by ink jetting to the substrate.

9. The printing plate of claim 8, in which the substrate is dried subsequent to ink-jetting.

10. The printing plate of claim 8, in which the non-aqueous solvent is diglyme.

11. The printing plate of claim 8, in which said compound is a polymer or copolymer comprising a monomer selected from the group consisting of 2-vinylpyridines, 4-vinylpyridines, and ethylimidazolidone methacrylates.

12. The printing plate of claim 8, in which said compound is a copolymer of 4-vinylpyridine and butyl methacrylate.

13. The printing plate of claim 8, in which said compound is a copolymer of 4-vinylpyridine, hydroxyethyl acrylate, ethyl acrylate, and methyl methacrylate.

14. The printing plate of claim 8, in which said compound is 2-pyridyl ethyl trimethoxysilane.

15. A method of preparing a printing plate comprising:

(a) providing a printing plate substrate; and (b) imagewise applying by ink jetting to the substrate a fluid composition comprising a compound comprising a nitrogen-containing heterocyclic moiety in non-aqueous solvent.

16. The method of claim 15, in which the printing plate is dried subsequent to application of the fluid composition.

17. The method of claim 15, in which the non-aqueous solvent is diglyme.

18. The method of claim 15, in which said compound is a polymer or copolymer comprising a monomer selected from the group consisting of 2-vinylpyridines, 4-vinylpyridines, and ethylimidazolidone methacrylates.

19. The method of claim 15, in which said compound is a copolymer of 4-vinylpyridine and butyl methacrylate.

20. The method of claim 15, in which said compound is a copolymer of 4-vinylpyridine, hydroxyethyl acrylate, ethyl acrylate, and methyl methacrylate.

21. The method of claim 15, in which said compound is 2-pyridyl ethyl trimethoxysilane.

22. A method of forming an image onto a printing plate substrate comprising:

(a) providing a printing plate substrate;

(b) imagewise applying by ink jetting to the substrate a fluid composition comprising a compound comprising a nitrogen-containing heterocyclic moiety in non-aqueous solvent, in which the fluid composition forms the image; and (c) drying the fluid composition on the substrate.

23. An imaged printing plate substrate comprising:

(a) a printing plate substrate; and (b) an imaged ink-receptive layer residing on the substrate, wherein the layer comprises a compound comprising a nitrogen-containing heterocyclic moiety imagewise applied to the substrate by ink jetting.

24. A method of copying an image onto a medium comprising:

(a) providing a substrate; and (b) applying by ink jetting to the substrate a fluid composition comprising a compound comprising a nitrogen-containing heterocyclic moiety in non-aqueous solvent, in which the fluid composition forms the image;

(c) drying the fluid composition on the substrate;

(d) contacting the dried formed image with an ink thereby coating the formed image with the ink; and (e) contacting the formed image coated with the ink with a medium capable of receiving the ink in the form of the image.

25. The printing plate of claim 1 wherein the substrate is a grained and anodized aluminum sheet.

26. The printing plate of claim 25 wherein the grained and anodized substrate is further treated with a surfactant prior to application of the fluid composition.

27. A printing plate prepared by the process comprising:

(a) providing a substrate; and (b) applying by ink jetting to the substrate a fluid composition comprising a compound comprising a nitrogen-containing heterocyclic moiety in diglyme.

28. A printing plate prepared by the process comprising:

(a) providing a substrate; and (b) applying by ink jetting to the substrate a fluid composition comprising 2-pyridyl ethyl trimethoxysilane in non-aqueous solvent.

29. A printing plate comprising:

(a) a substrate; and (b) an imaged ink-receptive layer residing on the substrate, wherein the layer comprises a compound comprising a nitrogen-containing heterocyclic moiety in diglyme applied by ink jetting to the substrate.

30. A printing plate comprising:

(a) a substrate; and (b) an imaged ink-receptive layer residing on the substrate, wherein the layer comprises a compound comprising 2-pyridyl ethyl trimethoxysilane in non-aqueous solvent applied by ink jetting to the substrate.

31. A method of preparing a printing plate comprising:

(a) providing a substrate; and (b) applying by ink jetting to the substrate a fluid composition comprising a compound comprising a nitrogen-containing heterocyclic moiety in diglyme.

32. A method of preparing a printing plate comprising:

(a) providing a substrate; and (b) applying by ink jetting to the substrate a fluid composition comprising 2-pyridyl ethyl trimethoxysilane in non-aqueous solvent.

33. A printing plate prepared by the process comprising:

(a) providing a printing plate substrate; and (b) imagewise applying by ink jetting to the substrate a fluid composition comprising a compound comprising a nitrogen-containing heterocyclic moiety in non-aqueous solvent, wherein the process does not comprise a development step.

34. A printing plate prepared by a process that does not comprise a development step, the printing plate comprising:

(a) a printing plate substrate; and (b) an imaged ink-receptive layer residing on the substrate, wherein the layer comprises a compound comprising a nitrogen-containing heterocyclic moiety in non-aqueous solvent imagewise applied by ink jetting to the substrate.

35. A method of preparing a printing plate comprising:

(a) providing a printing plate substrate; and (b) imagewise applying by ink jetting to the substrate a fluid composition comprising a compound comprising a nitrogen-containing heterocyclic moiety in non-aqueous solvent, wherein the method does not comprise a development step.

36. A method of forming an image onto a printing plate substrate comprising:

(a) providing a printing plate substrate;

(b) imagewise applying by ink jetting to the substrate a fluid composition comprising a compound comprising a nitrogen-containing heterocyclic moiety in non-aqueous solvent, in which the fluid composition forms the image; and (c) drying the fluid composition on the substrate, wherein the method does not comprise a development step.

37. An imaged printing plate substrate prepared by a process that does not comprise a development step, the imaged printing plate substrate comprising:

(a) a printing plate substrate; and (b) an imaged ink-receptive layer residing on the substrate, wherein the layer comprises a compound comprising a nitrogen-containing heterocyclic moiety imagewise applied to the substrate by ink jetting.

* * * * *